United States Patent [19]

Lovell et al.

[11] 3,981,652

[45] Sept. 21, 1976

[54] MACHINE FOR PARTLY COATING ARTICLES

[75] Inventors: Walter C. Lovell, Wilbraham; Frederick G. J. Grisé, Magnolia, both of Mass.

[73] Assignee: USM Corporation, Boston, Mass.

[22] Filed: Aug. 5, 1974

[21] Appl. No.: 494,985

[52] U.S. Cl. ..... 425/111; 113/80 B; 113/121 C; 118/33; 118/503; 425/125; 425/126 R

[51] Int. Cl.[2] ..... A23G 1/20

[58] Field of Search ..... 113/1 F, 80 B, 80 C, 113/80 D, 80 DA, 121 R, 121 C; 118/37, 39, 211, DIG. 3, 253, 33, 503, 505; 425/125, 129, 111, 126 R

[56] References Cited

UNITED STATES PATENTS

| | | | |
|---|---|---|---|
| 1,639,118 | 8/1927 | Troyer et al. | 113/80 B |
| 2,046,197 | 6/1936 | Kronquest | 113/80 B |
| 2,264,632 | 12/1941 | Gerlitzki | 118/DIG. 3 |
| 2,286,978 | 6/1942 | Rivera | 113/80 B |
| 2,288,224 | 6/1942 | Brenzinger | 113/80 B |
| 2,391,341 | 12/1945 | Pearson et al. | 113/80 B |
| 2,600,393 | 6/1952 | Cohn | 113/80 D |
| 3,135,019 | 6/1964 | Aichele | 425/125 |
| 3,265,035 | 8/1966 | Rosenstein et al. | 118/211 |
| 3,407,442 | 10/1968 | Wright | 425/125 |
| 3,641,959 | 2/1972 | Hurst | 113/80 DA |
| 3,759,206 | 9/1973 | Dalli et al. | 113/121 C |
| 3,886,881 | 6/1975 | Pearce et al. | 113/121 C |
| 3,888,199 | 6/1975 | Herrmann | 113/80 R |

*Primary Examiner*—Charlie T. Moon

*Attorney, Agent, or Firm*—Richard B. Megley; Vincent A. White; Carl E. Johnson

[57] ABSTRACT

Certain articles, including easy-open sheet metal can tops or covers, include closures which are, at least in part, defined by indentation and/or fracture through the metal. This invention provides a high speed mechanism for coating particular portions of the articles, for instance for sealing only the fractured locality of each successive cover, a shallow printing on applicator being in timed communication with a source of hot pressure fluid such as a hot melt or lacquer. A hold down or backing member precisely cooperates with the applicator in relative reciprocable, high speed to insure that sealant fluid is applied to the predefined locality of the article, and resilience in the article and/or sealing means such as O-rings of the applicator is, in effect, relied upon to provide dwell during the moment of coating thus providing rapid, economical production.

15 Claims, 9 Drawing Figures

MACHINE FOR PARTLY COATING ARTICLES

CROSS-REFERENCE TO RELATED APPLICATIONS

An application Ser. 454,384 filed Mar. 25, 1974 in the names of Walter Lovell and Frederick G. J. Grise, now U.S. Pat. No. 3,881,437 issued May 6, 1975 relates to a method of making pop-in container closures, and an application Ser. 463,056 filed Apr. 22, 1974 now U.S. Pat. No. 3,881,630 issued May 6, 1975 in their names pertains to the closure structure.

BACKGROUND OF THE INVENTION

This invention relates to mechanism for applying protective coating to selected surface portions and/or fractures therein, especially the fractured localities of easy-open sheet metal lids or the like.

The above cited patents are concerned with easy-open end closures for sheet metal cans. As therein disclosed a can lid is formed with a disruptable button portion defined by merging inner and outer wall portions inclined to the general plane of the lid. One of the walls is longitudinally indented in a coining operation while backed by a curved die surface thus preferably producing a fracture through the metal and extending roughly from about 120° to 180° peripherally. The locality of no indentation, generally opposite to the locality of greatest indentation and fracture, serves as a hinge for the closure when the button portion is pressed inwardly, and the fracture serves as an easy starting locality for the rupture. For insuring that the button portion adequately resists internal pressure, for instance such as may be generated by carbonated beverage or in the pasteurizing of beer, etc., a face of the indentation is dilated, as by a swedging step, relative to the fracture and yet permits closure disruption manually from outside the container.

Can lids of the general type indicated are customarily made at high speed on in-line, multi-station forming apparatus. The lids are usually conveyed sequentially as by endless belt to and through the forming and treating stations. While the precision forming and swedging generally produce uniformly fractured lids, there is variation inevitably in the sheet metal from which the lids are produced, and hence it is desirable to provide one lid making station at which the successive lid closures have their fracture rendered fluid tight with certainty and without modifying the substantially uniform can opening or rupturing force required. Moreover, sealing equipment of the type herein to be disclosed may well have application in the high speed production of can lids of different configuration and construction and whenever an economical coating for sealing and/or anticontamination is desired. Also, this invention has application in can making where, because of partial breakdown of a prior coating in a locality due to operation thereon of a scoring tool or the like, a local recoating is required.

In the prior art, for example as shown in U.S. Pat. No. 3,807,924, it is known to employ injectors for delivering batches of fluid plastic material, for instance to the interiors of caps. Also, in the making of can lids it is a common practice to spray a coating of lacquer or the like on one surface. Another known approach employs application of hot-melts or lacquers by direct contact. According to one system, for instance, a plurality of spaced, tiny globules of cement are deposited around the perimeter of a push-in closure; then the cover is placed in a hot oven to cause the globules to run together to form a continuous seal.

SUMMARY OF THE INVENTION

A main object of the present invention is to provide, in a high speed system for making metal can lids of the easy-open type, an effective and reliable mechanism of simple structure for applying an adequate but minimum coating to only a predetermined locality of each lid and preventing contamination of the system by misapplication of the coating fluid.

Another object of this invention is to provide, in a multi-station automatic cover or can top production line having button push-in shaping and indenting means, and a coining means for fracturing selected indented portions of the perimeters of the push-in button closures in the can tops, a fracture sealing station of simple construction which, without diminishing output of the line, causes fluid to penetrate into the indented portions to seal each fracture and thereby assure the integrity of each closure.

To these ends and as herein shown a coating and sealing mechanism features an upper backing member or hold down for engaging one side of a fractured cover to be sealed, and an applicator having a cavity communicating with a source of fluid sealant under pressure and adapted to engage the other side of the cover when it is cooperatively engaged by the backing member, the applicator cavity being shaped to confine the fluid for exposure to the cover only in the locality of the fracture. While the sealing mechanism is herein illustrated as applied to circular lids and closure rims, the invention is clearly thus not limited, but is useful in treating other closure shapes, and indeed upon other workpieces whether fractured or not. Preferably the illustrative coating and sealing mechanism occupies one of the down stream stations of a can cover production line wherein the series of stations is sequentially served by a flexible cover-carrying belt.

As herein shown an important feature of the invention resides in the combination, in a coating station, of an open cavity type fluid pressure pulsed applicator having resilient sealing means engageable with the periphery of a closure formed in each can lid and to be selectively coated, and a cyclically reciprocable die structure cooperative with the applicator on successive lids positioned therebetween, the die structure including an inner closure backing die cooperative with the sealing means at bottoming of the die structure during printing on of fluid from the cavity, and a radially outer lid-engaging portion for simultaneously stressing the lid on the applicator and momentarily holding the sealing means compressed. Alternatively, the invention is disclosed as embodied in a similar combination but having the discrete sealing elements eliminated in favor of relying on flexure and inherent resilience in the lid itself, the closure backing die being appropriately modified. In either arrangement, or in a combination of them, according to the present invention, the preset millisecond interval of pulsed pressure is, in effect, matched by the die backing means to attain an increased rate of production; resilience automatically substitutes for dwell at the bottoming of the die structure.

A further and more specific feature of the invention resides in the combination with a milli-second controlled lacquer or hot melt injector, of a backing member and a complemental print-like applicator relatively movable into and out of cooperative engagement with opposite sides, respectively, of peripherally indented can cover closures each having a partially fractured wall along a line to be sealed by the lacquer, a cavity surface of the applicator being defined by spaced peripheral sealing edges shaped to nip the indented side of the cover closure to confine the lacquer between opposite sides of the line of fracture. Another important feature resides in incorporation in the applicator of a resilient seal such as an O-ring compressible up to about 0.003 inch to, in effect, serve as an automatic dwell determining device during "bottoming" of the backing member and the applicator.

BRIEF DESCRIPTION OF THE DRAWINGS

The foregoing and other features of the invention, together with various novel details in construction will now be more particularly described in connection with an illustrative embodiment thereof, and with reference to the accompanying drawings, in which.

DESCRIPTION OF PREFERRED EMBODIMENT

Figure 1:
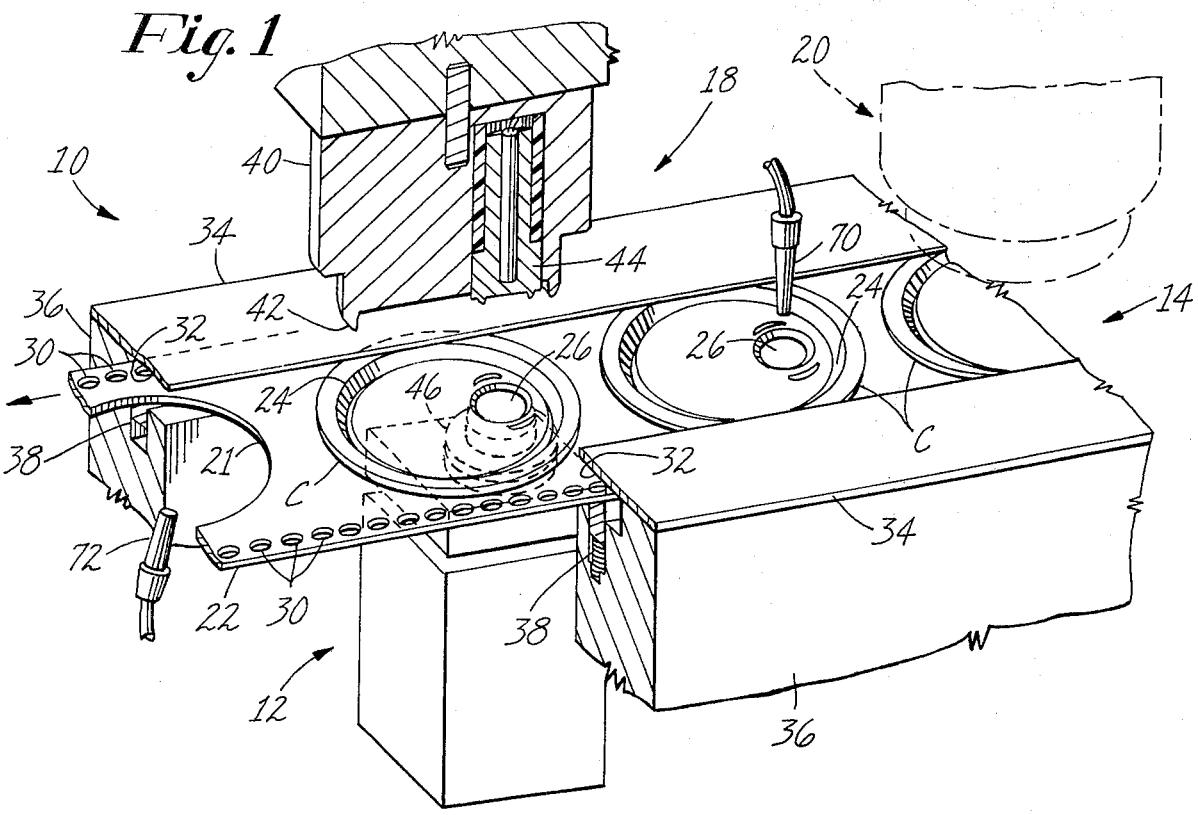
FIG. 1 is a view in perspective and partly in section showing a portion of a conveyorized can top making machine including a series of punchpress stations, one having fluid coating and fracture sealing means.

It will be appreciated that a so-called "printed on" or "injection molding" type of fracture sealing and coating mechanism now to be explained is useful in hot melt/or lacquer application systems of different types. A preferred punchpress sequential forming system 10 operative at high speed for high output, and in which our novel coating mechanism is embodied for purposes of this illustration, incorporates a constant pressure pump (not shown) with a regulating liquid system and an electrically triggered air valve generally designated 12 (FIGS. 1–2) operating in a range of from 5 to 10 milliseconds. This system (not herein fully shown) desirably includes a solid state timing means coordinating a production line generally designated 14 (FIG. 1), whereby intervals of pressure fluid application to a channel 16 (FIG. 2) of a fracture sealing and coating station designated 18 (FIG. 1) are varied in millisecond increments.

Fluid F (FIGS. 3–5, 7–9) is to be applied usually as a lacquer or hot melt to predetermined portions only of workpieces such as can tops C which may respectively have lines of fracture L (FIGS. 5–6) to be sealed by the fluid. Accordingly at a station 20 (FIG. 1) and other stations upstream from the sealing and coating station 18 suitable lid forming and indenting dies and coining tools (not shown) are provided for operation upon successive sheet metal can tops C carried step-wise in spaced apertures 21 of an endless flexible steel belt 22 (FIGS. 1,2).

For purposes of illustration only it is herein assumed each formed lid C arrives and is laterally indexed outside-up at the station 18, with an annular outer groove 24 formed therein, and a button-like closure 26 provided adjacent thereto. When the closure 26 is of the types disclosed in the above-cited Lovell and Grise patents, it has a peripheral indentation 28 (FIG. 5) from the bottom of which extends the coining induced fracture L to be sealed. In many types of can closures there may be no fracutre to be sealed, but a precoating will have been interrupted in certain localities by forming tools or the like necessitating "repair," i.e. a new localized coating for insuring integrity against contamination, but not requiring a new coating over the whole can under-surface.

Preferably as shown in FIG. 1, the belt 22 is provided with marginal sprocket holes 30 and arranged to feed opposed rim portions of the can tops C in parallel ways 32,32 formed under spaced guide flanges 34,34. The latter desirably are secured on stationary parallel bars 36 which are respectively formed with longitudinal slots carrying, at least at the station 18, spring-pressed plungers 38 for yieldably supporting the belt 22 against downward displacement. For insuring that each top C is accurately positioned at the station 18 and for timing control purposes later mentioned, a backing member 40 is formed with a downwardly projecting annular centering ridge 42 adapted to nest in the groove 24 of each can top. The member 40 is vertically reciprocable toward and from operative relation with the top of each can lid arriving at the station 18 and carries a radially inner closure backing die 44 (FIGS. 3–5) arranged to cooperate with an applicator nozzle 46 as will hereinafter be explained.

Figure 2:
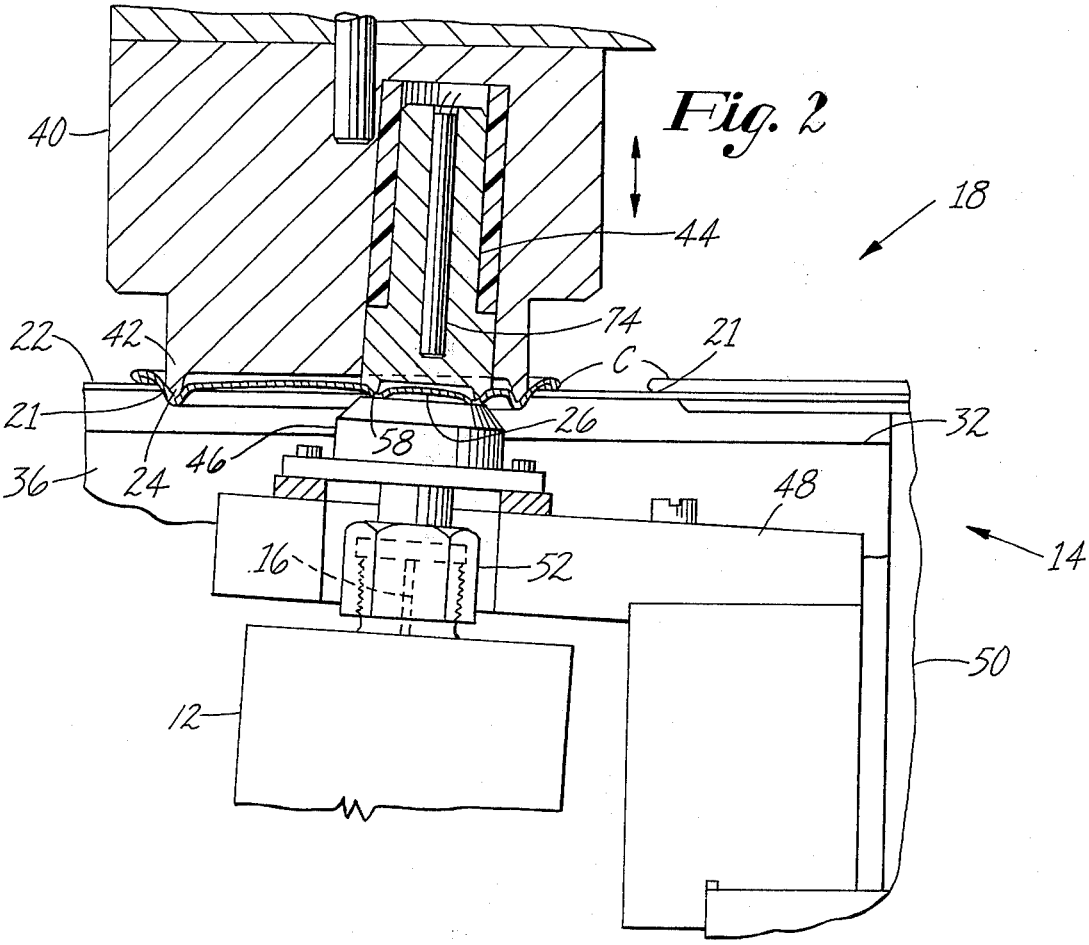
FIG. 2 is an enlarged view in elevation and partly in section showing the fracture sealing station of FIG. 1, its applicator and backing structure now having moved into operative relation for coating a predetermined portion of a can cover such as an indentation in its closure.
Figure 3:
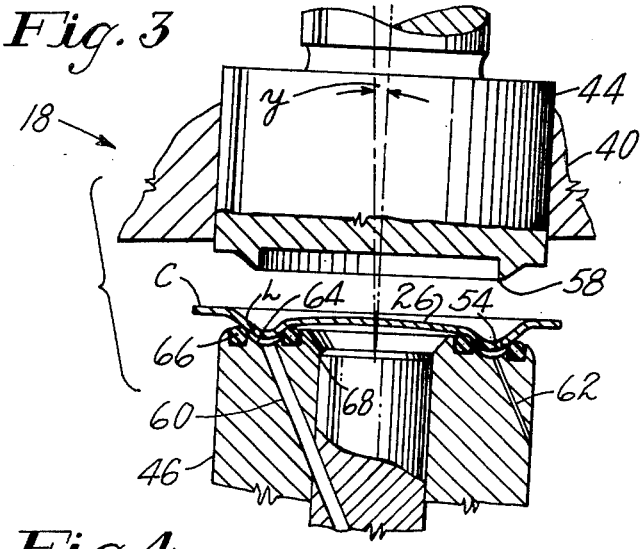
FIGS. 3–5 inclusive are further enlarged axial sections showing progressively the relative positions of the backing structure with its inner closure backing die and the applicator nozzle, the later carrying O-rings.
Figure 5:
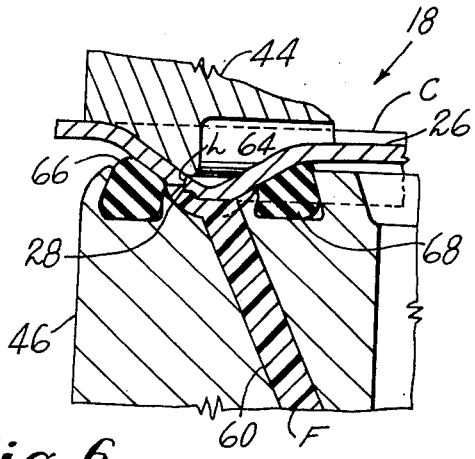
Figure 4:
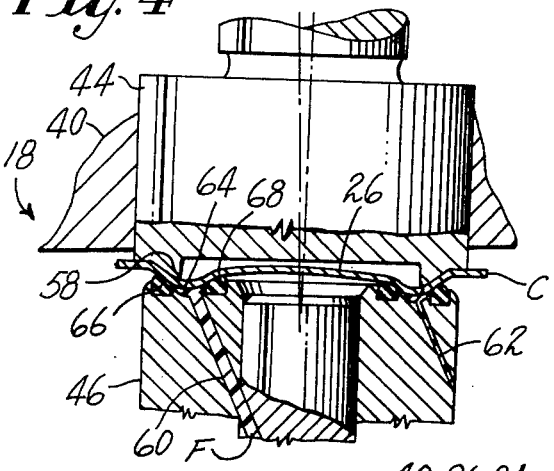

When, as indicated in FIGS. 2–4 inclusive, the groove 24 defines a somewhat convex can top surface and the closures 26 are located near the perimeter of such surfaces, the nearly aligned axes of the nozzle 46 is preferably at a small angle (FIG. 3) to the vertical axis of the backing die 44 to accommodate such convexity. The nozzle 46 is accordingly fixed secured on a slightly inclined bracket 48 (FIG. 2 affixed to the conveyer frame 50, and a stem of the nozzle is coupled as by a bolt 52 to the threaded upper end of the cyclically triggered air valve 12. Referring more particularly to FIGS. 3–5, the closures 26 have in this instance an annular groove 54 and one bounding wall of the closure 26 has the longitudinal indentation 28 (FIG. 5) from the bottom of which the fracture line L may extend. Whatever the particular closure formation and configuration it may be assumed that the coating of hot melt or lacquer F is to be applied only to the desired predetermined locality of the can top C, for example along the indentation and the line L. The backing die 44 is therefore provided with an annular tapered ridge 58 (FIGS.

3–5) formed to engage, at the bottom of each stroke, an inclined outside wall of the indentation 28 as indicated in FIGS. 4 and 5. The applicator nozzle 46 is formed with an inlet bore 60 communicating with the pressurized channel 16, and has a smaller bored air vent and sump return or overflow outlet 62 diametrically disposed to the inlet 60. Upper ends of the bores 60,62 terminate in an open cavity 64 conforming substantially to the underside locality of the can top to be coated. It will be understood that the closure indentation 28 (and the fracture L if any) will be urged downwardly in the cavity 64 and momentarily prevented from rising therein, spaced annular localities of the underside of the can top C being resiliently engaged by O-rings 66,68 recessed in the nozzle at opposite edges of the cavity as clearly shown in FIG. 5.

The O-rings 66,68 serve at the inner and outer cavity edges to seal off the particular work locality to be coated, and additionally function advantageously, by reason of their resilience, to avoid any need for providing a bottom dwell in the punchpress mechanism controlling the reciprocating backing member 40. The rings 66,68 operate to effectively limit and precisely define the printed on coating locality between them of each can top C. In the brief interval it is partly exposed to the pressure fluid pumped into the cavity 64 synchronously with the bottoming of the backing die 44. The ridge 58 resists deformation or displacement of the closure 26, and simultaneously the backing ridge 42 resists upward displacement of the can top C as a whole. Depending upon the shape of the particular indented or other portion of the lid to be coated, the ridge 42 may extend to the same extent as, or more or less than, the ridge 58 from the backing die structure thereby flexing and locally stressing each lid as desired.

The lacquer or hot melt F has a viscosity low enough to wet and adhere to the can top locality exposed between the O-rings. In addition to possible other heating means at prior stations, it may be desirable in the case of hot melt treatment to provide a continuous stream of hot air from nozzle 70 (FIG. 1) for preconditioning each closure 26 about to move into the coating and sealing station 18. If a lacquer is being applied, the nozzle 70 may or may not be required, but a nozzle 72 for directing hot air flow upwardly against the coated and/or sealed can tops leaving the station 18 may be desirable for driving off solvent. At the station 18, as indicated in FIG. 2, suitable temperature maintenance may be attained as by the provision of an electric heating element 74 within the backing die 44.

It will be understood from the foregoing that each can top C or the like indexed to the coating and/or sealing station 18 has its predetermined locality to be coated positioned in the otherwise open cavity 64. Cyclical bottoming of the backing member 40 and of the backing die ridge 58 against the closure groove 54 substantially coincides timewise with the valve controlled injection of pressure fluid F into the applicator cavity and the yielding of the rings 66,68 as they nip the sheet metal of the succesive closures to seal off respective selected portions to be "printed" with lacquer or hot melt. As indicated in FIG. 3 the fluid F is supplied to the inlet bore 60 but is not under pressure and admitted to flow in the cavity 64 for application to the selected can top locality until the rings 66,68 have been resiliently compressed as above indicated and shown in FIG. 4. Then, for the brief interval of closing the cavity 64 by means of the tapered ridge 58 acting on one side of the closure 26 and the rings 66,68 bearin (in this case concentrically) on the opposite side of the closure, the timed pressure pulse forces the fluid F to flow and fill the indentation 28 including the fracture line L if any. When the sealed cavity and fracture are thus being filled, the bore 62 serves as an air vent and allows excess fluid if any to be dumped or recycled. Now the can top C easily separates from the printing on nozzle 46 as the backing die 44 is again relatively elevated. Though not herein shown it will be understood that the successive coated and/or fracture sealed can tops may be removed by any suitable means such as, for instance, an air blast from the downsteam nozzle 72.

Figure 6:
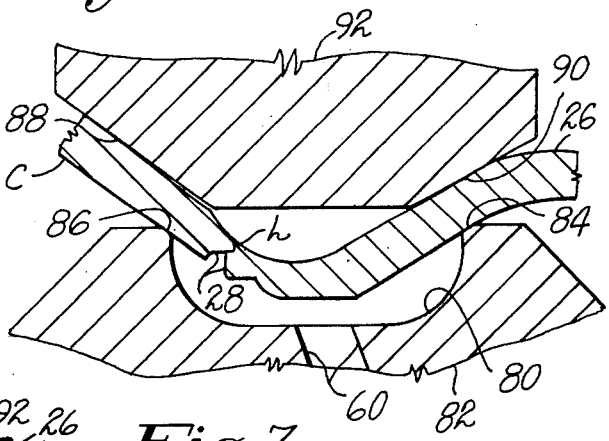
FIG. 6 is an enlarged view similar to FIG. 5 but showing an alternative construction wherein, in lieu of providing resilient O-rings, the backing die and applicator have a modified configuration employing resiliency in a can top itself for effecting sealing.
Figure 7:
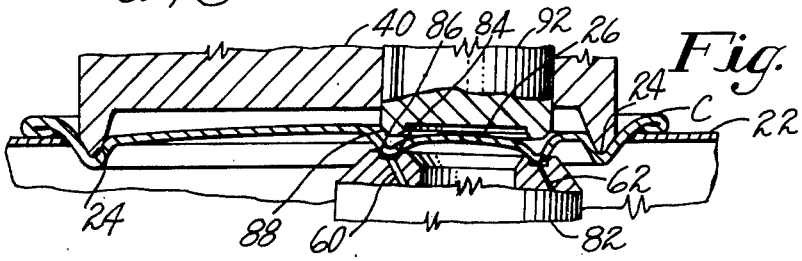
FIGS. 7–8 are sectional views showing at successive stages cooperative relation of the modified die of FIG. 6 and an applicator in coating predetermined portions of a can lid, the lid now being stressed outwardly of the applicator as well as inwardly thereof, and the lid flexure being shown exaggerated.
Figure 8:
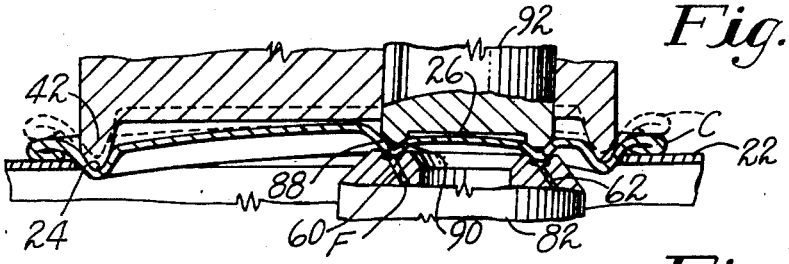

Referring to FIGS. 6–8 inclusive a variant of the invention will next be described wherein, in lieu of relying on a discrete resilient sealing means such as the rings 66,68, the equivalent of a bottom dwell of the backing die 44, that is to say the effective sealing and operating time of the printing on applicator 46, is established and increased by utilizing heightwise yield and deflection in the sheet metal of the can top itself. For this purpose the indented locality 28 and the fracture line L to be coated, as before, are received in an open cavity 80 (FIG. 6) formed in the upper end of an applicator nozzle 82. The cavity 80 is supplied with the liquid F in the same manner previously described, but the inner and outer edges 84,86 respectively which define the cavity lie substantially in a horizontal plane and are spaced to sealingly nip and clamp directly on the inside sloping wall surfaces of the closure 26 when complemental or nearly complemental walls 88,90 of a backing die 92 (corresponding to the die 44) engage the upper wall surfaces of the closure 26. It will in some cases be desirable to have the wall 88 at a slightly different angle than the confronting surface of the closure as shown in FIG. 6 when it is desired, for instance to momentarily open the fracture line L for the reception of sealing fluid F.

Figure 9:
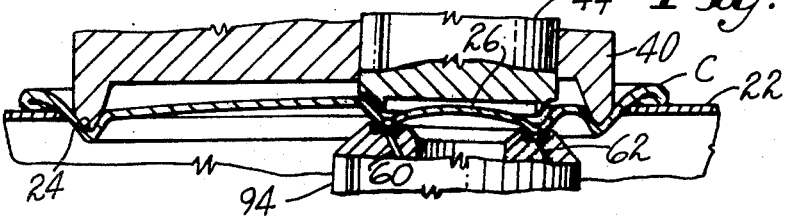
FIG. 9 is a view similar to FIG. 8 but showing another alternative construction wherein both O-rings (as in FIGS. 3–5) and resiliency in a can top are advantageously used (as in FIGS. 7–8).

FIG. 9 shows a further variant which combines the O-ring feature disclosed with respect to FIGS. 3–5 and the resiliency due to can top bending and/or deflection incurred in the cooperation of the applicator nozzle 94 and the backing members 40,44. It will be understood that the nozzle 94 has an open cavity such as 80 in FIG. 6, but that immediately adjacent to the angular can top nipping edges of the cavity the resilient O-rings 66,68 are also provided for sealing. The FIG. 9 arrangement may accordingly afford most latitude in determining the printing on and sealing time in each cycle.

As has been noted in the copending applications above cited, a portion of the perimeters of the closures 26 may remain non-indented and non-fractured to serve as a hinge when opening pressure is externally applied manually. In such cases it is common to provide a deeper indentation and/or greater degree of fracture in the sheet metal at a locality opposite to the hinge portion, and accordingly it is found advantageous to position the upper or delivery end of the bore 60 to correspond with the locality of greatest indentation and/or fracture and to oppositely position the upper or venting end of the bore 62 substantially at or adjacent to the hinges locality of the closure.

It will be appreciated from the foregoing that the invention enables the reciprocating die structure 40,44 to function at high speed, resilience in the sealing means 66,68 and/or inherent in the work pieces automatically extending each coat applying interval beyond the pressure pulsing whereby effective coating is attained with high output rates.

What is claimed is:

1. A sealing and coating device for use in a high production can making machine in which operating means affects the sealing integrity of can lids along a predetermined tear line, said device comprising an applicator having an open sealant receiving cavity adapted to be in timed communication with a fluid sealant injector means, said cavity having lid engaging upper masking edges disposed substantially in a horizontal plane and of a configuration to confine the sealant when pressurized to a local portion of the lid including the predetermined tear line, a complemental backing die having spaced portions for bearing on each lid adjacent to its rim and to said local portion, and movable into and out of registry with the applicator on the opposite side of each can lid from the side thereof engageable by the applicator cavity edges, the die and applicator being cyclically cooperative, and the applicator being provided with a yieldable lid sealing means compressible adjacent to its cavity edges to automatically determine the precise duration of each printing on of fluid.

2. A coating device for treating portions of generally planar sheet metal lids having a disruptable closure defining ridge on one side of the respective lids and a complemental groove formed respectively on the opposite side of the lids between the walls of said ridge, said device comprising a movable back-up die having axially protruding work engaging surfaces respectively shaped to nest in said complemental groove of the closure and bear on the periphery of the lids, and an applicator registerable and cooperative with the die and having laterally spaced masking edges arranged, respectively, to nip and mask the walls of the closure ridge when the die and applicator are relatively moved together, said applicator having an open cavity bounded by the masking edges for receiving pressure fluid sealant when the closure ridge is thus nipped by the masking edges.

3. A device as set forth in claim 2 wherein said cavity is bounded by sealing means arranged to accommodate the closure ridge and resiliently compressible by bottoming of the back-up die.

4. A device as set forth in claim 3 wherein the back-up die includes a closure backing die detachably mounted eccentrically in a vertically reciprocable presser member to accommodate an off-center closure in each lid which is slightly convex, and an axis of the applicator is slightly inclined to the vertical to accommodate the convexity of the lid.

5. A machine for applying a coating to indented side portions of sheet metal container lids comprising an applicator assembly constituted by a cavity type applicator, a lid-backing means including a closure backing die movable at high speed into and out of cooperative registry with the applicator, a lid holder for holding each lid so that its indented side is exposed for the application thereto of coating fluid supplied by pressure pulse to the cavity in the applicator for application during bottoming of the die, the cavity being defined by masking edges adapted to confine the fluid when pressurized to the locality of lid indentation on said side when the backing die engages the opposite side of the lid, a projecting portion of the die engaging the lid closure being sectionally generally convex for depressing and stressing said opposite side momentarily between said masking edges.

6. A coating machine as in claim 5 wherein radially inner and outer masking edges of the cavity are respectively fitted with sealing rings compressible by the lid backing means, the applicator is substantially stationary, and the holder is yieldable heightwise between determined limits and indexable to present successive lids in registry with the applicator.

7. In a station for coating a predetermined portion of a sheet metal workpiece, such as an indented closure portion of a can lid, the combination of an open cavity type fluid applicator having resilient sealing means engageable with the closure portion for defining the locality to be coated, and a reciprocable die structure cooperative with the applicator on successive lids positioned therebetween, the die structure comprising a closure backing die cooperative with the sealing means at bottoming of the die structure during printing on of fluid from the cavity, and a radially outer lid-engageable portion for simultaneously stressing the lid on the applicator and momentarily holding the sealing means compressed for the printing on interval.

8. A coating station as in claim 7 wherein the resilient sealing means is in the form of spaced rings respectively partly recessed in grooves adjacent to bounding edges of the applicator cavity, the closure backing die having an axially projecting portion arranged to bear on a portion of the closure indentation opposite to one of the rings.

9. In a machine for coating at least predetermined portions of sheet metal lids, means for supporting successive lids to be coated at an operating position, a coating device having a cavity for receiving and exposing coating fluid, sealing means carried by said device and resiliently engageable with the predetermined lid portions, respectively, in said operating position to confine the fluid, a millisecond controlled fluid injector for cyclically pressurizing said cavity, and a reciprocable backing means cooperative with the coating device in synchronization with the pressurizing of said cavity, the backing means including a portion engageable with each lid to urge its predetermined portion into the fluid in said cavity when pressurized and against said sealing means.

10. A machine as in claim 9 wherein the lid supporting means is an indexable endless belt having spaced apertures sized for holding the lids by their rims, and the backing means includes radially inner and outer lid engaging dies substantially simultaneously operable.

11. The combination with an applicator having a cyclically pressurized cavity for coating predetermined portions of successive sheet metal lids, of a conveyor for intermittently supporting each lid portion in position to be contacted by fluid in the cavity, and a lid backing means operable to and from lid engaging position along an axis substantially normal to the path of the conveyor, bottoming of the backing means being timed for coincidence with the pressurizing of the cavity and dwell of the conveyor, and said applicator including a yieldable cavity masking means displaceable during engagement with each lid to mask the lid portions to be fluid contacted during, slightly before, and slightly after bottoming of the backing means.

12. In high speed multi-station apparatus for making sheet metal container lids in sequential steps, a coating station including a backing member engageable with one side of each lid, an applicator having a continuous, open cavity communicating with a source of sealant fluid under pressure and mounted for engagement with the other side of each lid for cyclical cooperation with the backing member, said backing member and the applicator being mounted for yieldingly relative movement of approach and separation along a substantially vertical axis, lid-engaging edges of said cavity being shaped to nip the lids and confine the fluid for exposure to the lid only in a predetermined locality, a cyclically timed fluid injector connected to the applicator for controlling supply of fluid to the cavity during applicator bottoming, and yieldable seal means adjacent to the cavity edges for defining the locality of each lid to be coated.

13. Apparatus as in claim 12 wherein the backing member is formed with a die ridge generally convex in section to nest in a preformed groove in each lid, and the applicator has its lid-engaging edges arranged to straddle the convex die ridge while pressure fluid is forced into the cavity to coat said predetermined locality.

14. Apparatus as in claim 12 wherein a yieldable seal in the form of a pair of resilient rings is partly recessed in the applicator adjacent to the spaced edges of its cavity to limit precisely the locality and duration of the printing on of coating of the liquid, said backing member including an axially projecting portion arranged to engage each lid radially outwardly of said printing locality to stress the lid over the applicator and thereby control compression of the rings.

15. Apparatus as in claim 12 wherein the backing member and the applicator at said coating station are mounted for yieldingly relative movement of approach and separation along a substantially vertical axis, a cyclically timed fluid injector is connected to the applicator for controlling supply of fluid to said cavity during applicator bottoming, and yieldable seal means inherent in deflection and deformation of the lid being coated for defining the locality of each lid to be coated.

* * * * *

UNITED STATES PATENT OFFICE

CERTIFICATE OF CORRECTION

Patent No. 3,981,652 Dated September 21, 1976

Inventor(s) Walter C. Lovell et al.

It is certified that error appears in the above-identified patent and that said Letters Patent are hereby corrected as shown below:

On the Cover Page, delete Item [73]

Signed and Sealed this

Seventh Day of June 1977

[SEAL]

*Attest:*

RUTH C. MASON
*Attesting Officer*

C. MARSHALL DANN
*Commissioner of Patents and Trademarks*